United States Patent [19]

Julius

[11] Patent Number: 4,668,381

[45] Date of Patent: May 26, 1987

[54] METHOD OF AND APPARATUS FOR SEPARATING ELECTRICALLY CONDUCTIVE NON-FERROUS METALS

[75] Inventor: Jörg Julius, Düsseldorf, Fed. Rep. of Germany

[73] Assignee: Lindemann Maschinenfabrik GmbH, Düsseldorf, Fed. Rep. of Germany

[21] Appl. No.: 706,604

[22] Filed: Feb. 28, 1985

[30] Foreign Application Priority Data

Feb. 29, 1984 [DE] Fed. Rep. of Germany ..... 3407326

[51] Int. Cl.[4] ..... B07B 13/00

[52] U.S. Cl. ..... 209/39; 209/212; 209/231; 209/139.1

[58] Field of Search ..... 209/39, 138, 139 R, 209/212, 231, 225, 2

[56] References Cited

U.S. PATENT DOCUMENTS

| | | | |
|---|---|---|---|
| 2,959,284 | 11/1960 | Molstedt | 209/138 |
| 4,010,096 | 3/1977 | Murray et al. | 209/139.1 |
| 4,069,145 | 1/1978 | Sommer et al. | 209/212 |
| 4,137,156 | 1/1979 | Morey et al. | 209/212 |

FOREIGN PATENT DOCUMENTS

| | | | |
|---|---|---|---|
| 0038767 | 10/1981 | European Pat. Off. . | |
| 1482424 | 5/1971 | Fed. Rep. of Germany . | |
| 2509638 | 9/1975 | Fed. Rep. of Germany . | |
| 1347498 | 11/1963 | France | 209/212 |
| 468212 | 6/1937 | United Kingdom | 209/139 |
| 1185440 | 3/1970 | United Kingdom . | |
| 53569 | 4/1977 | U.S.S.R. | 209/39 |
| 74169 | 6/1977 | U.S.S.R. | 209/39 |
| 74167 | 6/1977 | U.S.S.R. | 209/39 |
| 722609 | 4/1980 | U.S.S.R. | 209/39 |
| 848093 | 7/1981 | U.S.S.R. | 209/139 R |
| 200361 | 4/1983 | U.S.S.R. | 209/139 R |

OTHER PUBLICATIONS 722 609 (VNIIPVTORTSVETMET) 05.04.1980, Soviet Inventions Illustrated, Derwent Publications Ltd., Woche C44 Zusammenfassung Nr., K6164, 10 Dec. 1980.

*Primary Examiner*—Kenneth M. Schor

*Attorney, Agent, or Firm*—Toren, McGeady and Goldberg

[57] ABSTRACT

In separating a mixture of solid material particles including non-magnetic electrically conductive metals into a light fraction and a heavy fraction, where the light fraction includes the non-magnetic particles, the mixture is directed into an upwardly extending airflow passageway from an inlet channel extending laterally from the passageway. The inlet channel is spaced between the inlet and outlet ends of the passageway. An alternating magnetic field is provided adjacent the entrance of the mixture into the airflow passageway for accelerating the particles in the desired direction. The mixture is fed through the inlet channel into the airflow passageway in layer form, preferably as a single layer. A main flow of air passes upwardly through the airflow passageway from the lower inlet end and develops a highly turbulent vortex-like airflow. The airflow, in combination with the magnetic field, effects separation of the light and heavy fractions of the material. A secondary flow of air is directed upwardly into the air flow passage in the region of the introduction of the mixture and accelerates the air flow and carries the light fraction upwardly to the outlet end of the passageway.

4 Claims, 5 Drawing Figures

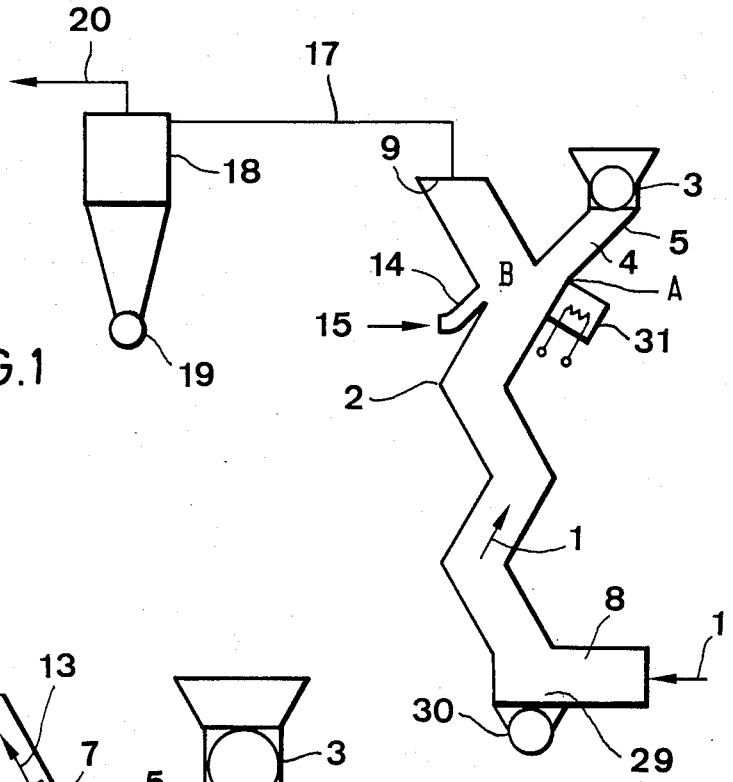
FIG.1
FIG.2
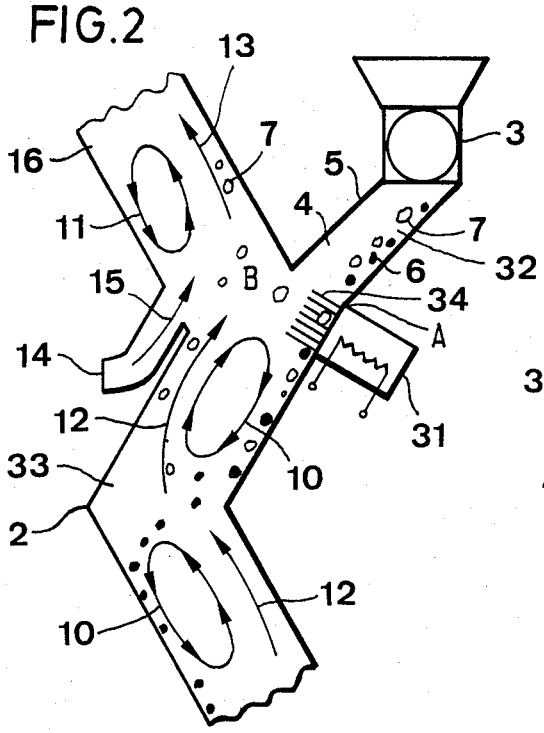
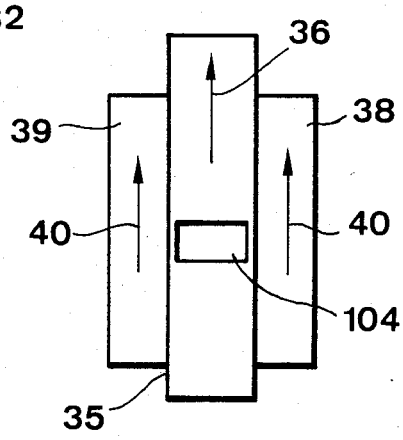
FIG.5

METHOD OF AND APPARATUS FOR SEPARATING ELECTRICALLY CONDUCTIVE NON-FERROUS METALS

BACKGROUND OF THE INVENTION

The present invention is directed to a method of and apparatus for separating non-magnetic, electrically conductive metals from a mixture of solid particles utilizing an airflow in combination with an alternating magnetic field as the separating means. The airflow is developed in the upward direction through a passageway with the air supply being introduced at the lower inlet end and removed at the upward outlet end. An inlet channel is provided for introducing the mixture of solid particles into the airflow passageway.

In so-called eddy current separation, the materials to be separated are guided between the poles of an alternating magnetic field producer such as on a belt or in a free fall. The eddy currents are induced in the favorably electrically conductive component parts of the mixture to be separated and the eddy currents develop their own magnetic fields directed oppositely to the producer field and, accordingly, the particles are accelerated relative to the rest of the particles in the mixture by electromagnetic forces. With eddy current separation, non-ferrous materials with good electrical conductivity, such as aluminum and copper can be separated from scrap and waste such as automobile scrap, glass waste and the like. In the event ferromagnetic particles are present in the feed, a magnetic separation must be provided before passage through the eddy current separating apparatus, since the ferromagnetic particles would obstruct the working space in the separating apparatus. It is advisable that other preparation stages should precede eddy current separation in order to improve separation efficiency.

Air classification is especially suited for separating lighter particles from heavier particles. The separation is effected, according to the descending speed, in vertical or horizontal air currents. To separate the light and heavy particles the mixture of such particles must be classified within narrow limits to obtain the desired high product grades.

In an air classifier, the airflow directed against the particle flow to be separated, is adjusted so that small (and also large) heavy particles with a form factor deviating sharply from the spherical shape fall downwardly while small and lighter particles are carried upwardly by the airflow. Problems may possibly occur if a portion of relatively large lighter particles are present which fall along with the heavier particles based on their absolute weight and sphere-like form factor. If the strength of the airflow is increased, the larger and lighter particles could be carried along with the other lighter particles, however, at the same time a substantial portion of the heavier particles with corresponding particle or grain size and shape would be carried away with the lighter particles.

Since smaller sized particles of various specific weight can be separated relatively well by air classification, the eddy current separation supposes a minimum particle size when non-ferrous metals are being separated from a mixture of solid particles in a variable magnetic field, because a continuous separating action with a reasonable expenditure of material and energy is only practical, according to this method, for mixtures where the smallest particle size has a diameter of approximately 15 to 20 mm.

A device for eddy current separation in a duct or passageway in which the airflow favors only the loosening of the introduced mixture, is suggested in German Offenlegungsschrift No. 25 09 638. The individual particles in the mixture to be separated arrive in a free fall within the air flow through the gap of an alternating magnetic field producer with the field travelling in a direction transverse to the falling direction. A chief disadvantage of the known device is that the particles in the mixture to be electromagnetically influenced in the direction of the travelling wave must be moved transversely to the flow of the falling particles with the possibility that the various particles collide and interfere with the separation. The portion of the particles inadvertently displaced rises with a mixture introduced into the separator which is not extensively scattered and therefore both products contain the two types of particles due to hindrance and entrainment. The air flowing through the particles should serve to loosen the mixture to be separated in the inlet channel or shaft before the separation zone is reached and not to separate particles of different density. Moreover, a common discharge of purely granular, lighter particles together with coarser lighter particles deflected by the alternating magnetic field producer is not considered. Finally, the individual particles have no defined position and, therefore, can be turned by the alternating magnetic field in a direction in which the field can exert only a relatively small separating force determined by the eddy currents on the individual particles.

SUMMARY OF THE INVENTION

Therefore, it is the primary object of the present invention to improve the separation method described above so that the electrically conductive particles influenced by the alternating magnetic field can be substantially accelerated in the desired manner without any interference from adjacent particles. Based on the concept of separating the mixture by air classification and a eddy current separation at the same time to separate the smaller particles (by air classification) and the larger particles (by eddy current separation) into heavier and lighter particles and in the conductive and non-conductive particles, respectively, this object is attained by feeding the mixture of solid particles into a main separating airflow with, if possible, the mixture being in a single layer and being introduced into the flow at an angle relative to the airflow direction. In addition, larger sized light particles formed of non-magnetic, electrically conductive material as well as portions of such material present in the heavy fraction during only air separation because of the form factor, are carried over into the lighter particle flow due to the influence of the alternating magnetic field in the region where the mixture is introduced into the airflow passageway. Further, the airflow carrying the lighter particles is accelerated in the region where the mixture is introduced into the airflow passageway, preferably by providing an additional airflow supply.

As mentioned in the introduction, certain light particles are present in the heavy fraction during normal air classification because of their form factor, usually this involves spherically shaped particles. When referring to the "region of the introduction or feed of the mixture of solid particles" within the teaching according to the invention, the location of the introduction of additional airflow can be located in the airflow direction adjacent to and slightly upstream from the region of the introduction of the mixture and, when the alternating field producer is correspondingly arranged, it can be located in the region of the alternating field producer in the airflow direction adjacent to and downstream from the point where the mixture to be separated is introduced into the airflow passageway.

In an apparatus for performing the method, the air classifier is an air duct or passageway where the channel for introducing the mixture to be separated is located outside the airflow path so that the mixture is introduced through an opening laterally into the air passageway. In the region where the mixture is introduced, means for accelerating the airflow in the flow direction is arranged along with the alternating magnetic field producer with the direction of force developed by the alternating magnetic field being oriented in the direction of the air flow. Further, the direction of force extends transversely of a base edge of the opening from the inlet channel through which the mixture is introduced into the airflow passageway.

The acceleration of the airflow is achieved by increasing the airflow velocity in the flow direction so that it is higher upstream from the opening where the mixture is introduced into the airflow passageway than directly in front of the opening. The alternating magnetic field present in the region where the increase in velocity of the airflow is effected affords with appropriate polarity and alteration direction, that certain electrically conducting particles, down to a size determined by eddy current separation, can be lifted from the region of the lower air velocity into the region of the higher air velocity. When the air classifier airflow is adjusted for the separation of smaller particles (not the particles effected by eddy current separation), that is, lighter and heavier particles, then the eddy current separation, combined with the secondary airflow, respectively, affords an ideal way to separate relatively large lighter particles of the mixture, such as aluminum particles of sphere-like shape or form factor, whereby these particles are lifted from the region of lower air velocity to the region of higher air velocity where they are carried along by the increased velocity air flow with the other lighter particles. Therefore, with the method embodying the present invention there is no risk that relatively small heavier particles will be discharged with the lighter particles flowing out of the airflow passageway. Further, in accordance with the present invention, due to the arrangement of the edge over which the mixture of solid particles flows into the airflow passageway, preferably formed by the angular opening from the inlet channel into the airflow passageway, in contrast to the prior art, the mixture to be separated will be introduced into the air flow path in the passageway as well as into the operating region of the alternating magnetic field producer, possibly in the form of a single layer of the mixture.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing

FIG. 1 is a schematic view of an airflow passageway embodying the present invention and arranged to combine air classification and eddy current separation;

FIG. 2 is an enlarged detail view of the airflow passageway flow shown in FIG. 1 adjacent to the opening into the airflow passageway for the introduction of the mixture to be separated;

FIG. 5 is a sectional view taken along the line V—V in FIG. 4.

DETAILED DESCRIPTION OF THE INVENTION

Figure 3:
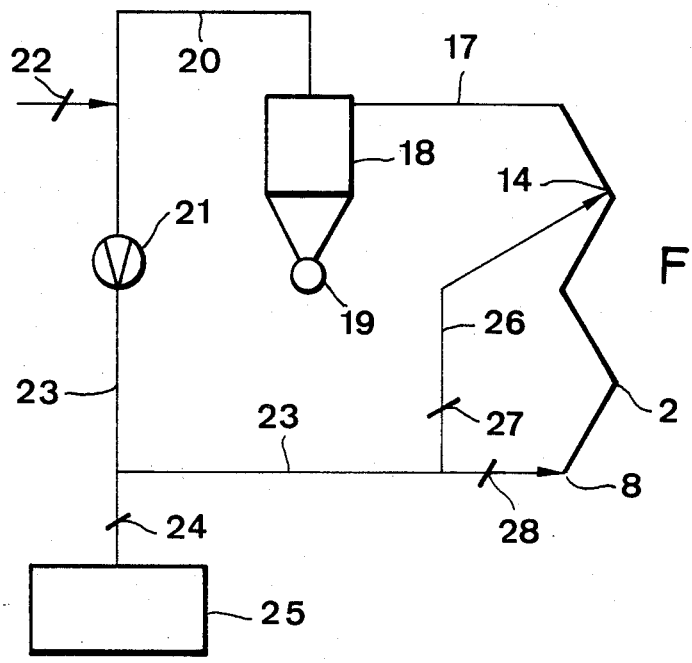
FIG. 3 is a flow chart of the airflow through the entire system embodying the present invention.

In the embodiment illustrated in FIG. 1, a mixture of solid materials is separated in an upwardly directed airflow path in a vertically arranged zig-zag-shaped airflow passageway 2 acting as an air classifier. Due to its shape, the airflow passageway forms a tortuous airflow path 1. As an alternative, differently shaped vertical or horizontal air ducts could be used. The mixture of solid materials to be separated is introduced into the airflow passageway 2 in the upper third of the passageway entering through a star feeder gate or lock 3. An opening 4 admits the mixture into the airflow passageway 2 and the opening is connected with the star feeder or wheel gate 3 by an inlet channel 5. Other means for carrying the mixture to the opening 4 could be used. Preferably, inlet opening 4 is located in the upper third or final third of the airflow passageway 2 as seen in the direction of the airflow path 1. At the transition from the inlet channel 5 into the airflow passageway 2, that is, in the region of the inlet opening 4, a base edge A defines, in its simplest construction, the connection between the lower part of the inlet channel 5 and the airflow passageway 2. The opening 4 defined along its lower edge by the base edge A defines the angle between the inlet channel 5 and the long axis of the airflow passageway 2. The mixture to be separated is introduced into the airflow passageway 2 through the inlet opening 4 and is made up, note FIG. 2, of heavier particles 6 and lighter particles 7 so that the mixture has a light fraction and a heavy fraction. As the mixture passes over the base edge A it falls downwardly into the airflow passageway 2 against the upwardly directed airflow path 1 which air is drawn in at the lower end of the passageway 2 through a main air feed 8. After its upward flow through the passageway 2 the air is drawn off at the upper outlet end via an air exhaust 9. Due to the zig-zag shape of the airflow passageway 2 as shown in the detail in FIG. 2, a highly turbulent air current is developed which favors the desired separation and provides so-called vortex-like flows 10 and 11. The upwardly directed main airflow travels in the passageway 2 as shown approximately by the arrows 12 and 13.

In the transition region B leading to the upper outlet zone 16, the transition region B lies approximately at the height of the inlet opening 4 where the mixture is introduced into the airflow passageway as shown in FIG. 1 and FIG. 2. In the region B a secondary air inlet connection 14 provides a secondary airflow 15 into the duct. The secondary airflow 15 adds to the airflow path 1 drawn in through the main air supply 8 so that the airflow path 13 provides a stronger airflow than in the downstream region of the passageway. The airflow path 13 extends through the upper outlet zone or passageway 16 in the upper end of airflow passageway 2. The outlet passageway 16 extends upwardly from the location of the inlet opening 4 and forms a continuation of the airflow path 1 through the passageway 2. As illustrated, the secondary air inlet connection 14 consists of a single line or it may open into the outlet passageway 16 in the form of several lines. Moreover, the inlet connection 14 can be provided in annular form at several locations.

The lighter particles are carried out in the upward direction through the airflow passageway 2 and are transported by the augmented airflow 13 through the outlet passageway 16 to the upper outlet end of the airflow passageway and then through a duct 17 into a cyclone 18 where the solid particles are separated from the flow of carrier air. In a preferred arrangement, the separated solid particles are discharged from the cyclone 18 through a star feeder gate or lock 19 while the separated air, as shown in FIG. 3, is conducted through a duct 20 to the suction side of a blower 21. In the system as shown in FIG. 3, the air from the cyclone 18 can be returned into the airflow passageway 2. Further, additional air can be introduced into the recirculated air through a valve 22 located between the cyclone 18 and the blower 21. The pressure side of the blower 21 can be connected with the main air supply 8 into the airflow passageway 2 through a duct 23. A partial flow of air can be taken from the duct 23 through a valve 24 and introduced into a filter 25 for separating dust. A partial flow of air can be returned to the secondary air inlet connection 14 into the airflow passageway 2 via a line 26. A valve 27 in line 26 controls the quantity of air directed to the secondary air inlet connection 14 while the valve 28 controls the air quantity directed into the main air supply 8. While the lighter fraction or particles are transported by the augmented airflow 13 to the cyclone 18, the heavier fraction passes downwardly through the airflow passageway 2 to the base part 29, counter to the airflow 12, and is removed from the lower end of the passageway through a star feeder gate 30, note FIG. 1.

In contrast to a conventional air separator, apart from the secondary air inlet connection 14, the present apparatus has an alternating magnetic field producer 31 arranged, as shown in FIGS. 1 and 2, below or downstream from the inlet opening 4 directly adjoining the base edge A. In the embodiment of FIGS. 1 and 2, the changing magnetic flux of the alternating magnetic field producer 31 is aligned preferably at a right angle to the flow 32 of the mixture of solid particles passing through the inlet channel 5 to the opening 4, that is, transversely relative to the base edge A. In another embodiment, alternating magnetic field producers can be installed on the two side surfaces of the airflow passageway in the region of the inlet opening with the magnetic field oriented in the direction of the airflow 13, note the embodiment illustrated in FIGS. 4 and 5. Coil systems controlled in a single or multiple phase manner with standard frequency can be used as the field producers 31 as well as coils which are operated with voltages of higher frequency. Air coils or iron-core coils can be utilized.

In the illustrated embodiment, the separating process is carried out as indicated more precisely in the detail illustration of the zig-zag shaped airflow passageway 2 according to FIG. 2. As discussed above, the strength of the airflow path 13 upstream from the secondary air inlet connection 14 in the outlet passageway 16 is substantially greater than that of the airflow 12 in the region 33 downstream of the inlet opening 4. The separation takes place with the mixture of solid particles being directed into the zig-zag-shaped airflow passageway 3 through the star feeder gate 30 and the inlet channel 5.

In the present invention, as contrasted to the prior art, due to the arrangement of the base edge A, the material to be separated is conducted to the opening 4 in the form of a single layer, if possible, as it drops into the airflow passageway 2 as well as into the field of the alternating magnetic field producer 31. In the prior art, the material to be separated falls into the separating zone distributed over the entire cross-section of a vertically extending shaft.

In the present invention, a vertical feed is intentionally avoided and the mixture to be separated is introduced laterally into the separating zone in the air duct passageway 2 so that in the embodiment of FIGS. 1 and 2, the mixture is continuously advanced along the inlet channel 5 until it approaches the inlet opening 4 into the separating zone within the airflow passageway 2. In this embodiment, the particles, as a rule, are arranged with their larger surfaces on the surface of the inlet channel 5 and the surfaces are subject to the alternating magnetic field produced adjacent to the base edge A so that a maximum repelling effect is obtained in the transverse direction relative to the base edge.

The above-mentioned alternative arrangement, where the field is travelling in the direction of the airflow path with alternating magnetic field producers installed on the two side surfaces of the passageway, will be discussed in more detail in the discussion of the embodiment in FIGS. 4 and 5.

The air velocity in the downstream or lower passageway region 33 of the airflow passageway 2 in the flow direction toward the inlet opening 4 is adjusted so that small heavy particles drop downwardly while small light particles are carried upwardly by the airflow and are carried away as part of the lighter fraction. To direct large lighter particles of aluminum or the like into the lighter fraction, the alternating magnetic field producer is used. In the alternating magnetic field 34 eddy currents are generated in the larger and lighter electrically conducting particles to be separated. The eddy currents are enclosed by their own magnetic field directed against the exciter field 34 whereby the larger lighter component parts 7 are repelled into the outlet passageway or zone 16 where a higher air velocity exists due to the secondary air inlet connection 14. The higher air velocity in zone 16 may also be obtained by providing zone 16 with a smaller cross-sectional area than the area of air flow passageway 2. With a corresponding adjustment of the air velocity, particularly by the appropriately proportioned supply of air at the secondary air inlet connection 14, the lighter fraction of the mixture of solid particles partly deflected with the aid of the alternating magnetic field can be adequately transported into the cyclone 18 following outlet passageway 16.

Another embodiment of the apparatus for separating electrically conductive non-ferrous metals with a combined air classification and eddy current separation is described as follows based on FIGS. 4 and 5. The separation in this embodiment is provided with an airflow path 36 flowing upwardly from the bottom of the airflow passageway 35 which is arranged vertically or is inclined down to a 45° angle to the vertical. The airflow path 36 is provided by a main air feed 108 directed into the lower end of the air flow passageway. The base of the vertically extending part of the airflow passageway 35 includes a star feeder gate 130 for discharging the heavier fraction from the passageway while the lighter fraction is discharged through the air exhaust 109 at the upper end of the passageway into a duct 117 and then into a cyclone, not shown, similar to the arrangement shown in the embodiment of FIG. 3. As in the airflow passageway 2 according to FIGS. 1 and 2, airflow passageway 35 has a laterally located inlet opening 104 at one end of a mixture conveying channel 105 with a star feeder gate 103 at the opposite end. In addition, a secondary air inlet connection 114 is arranged so that the air velocity in the upper part of the passageway 35 is higher than the velocity in the lower part of the passageway, in other words, the flow velocity is higher upstream from the inlet opening 104 as compared to the velocity downstream from the opening. Additional secondary air inlet connections can be located upwardly from the connection 114 to ensure an adequate flow out of the passageway of any heavier parts.

Figure 4:
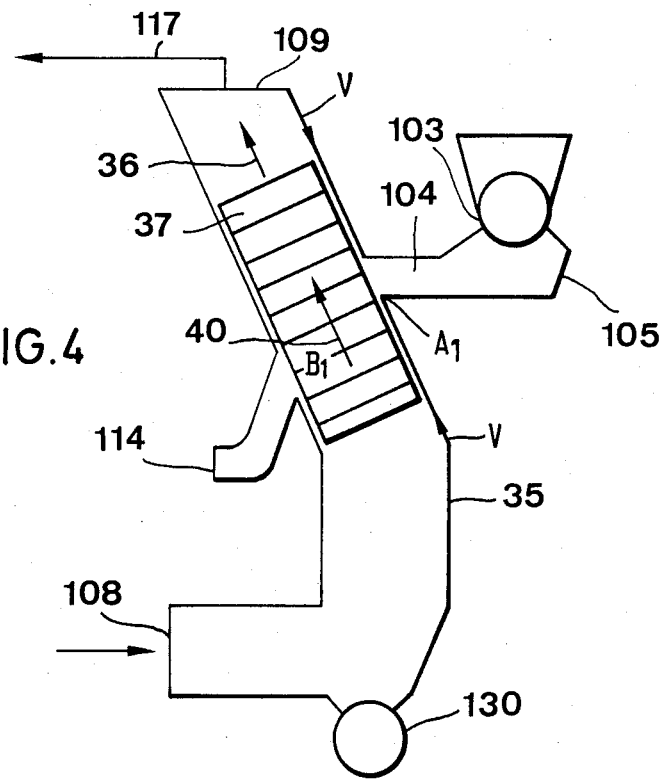
FIG. 4 is a schematic view, similar to FIG. 1, illustrating an alternative embodiment of the airflow passageway with combined air classification and eddy current separation.

In a similar manner as in the previously described embodiment, the mixture inlet channel 105 opens into the airflow passageway 35, as shown in FIG. 4, in the region of the inlet opening 104 defined on its lower side by a base edge $A_1$ and, in the simplest construction, through an angularly arranged channel 105 based on the angular arrangement of the axes of the channel 105 and the passageway 35.

Preferably, the airflow passageway 35 has a rectangular cross-section. Further, it is preferable to employ a linear motor as the alternating magnetic field producer 37. A double stator construction with poles 38 and 39 arranged at the opposite side surfaces of the passageway 35 is suitable, note the illustration in FIG. 5. The direction 40 of the fields produced by the two linear motors of the double stator construction is the same as the airflow path 36 in the airflow passageway 35 in the embodiment shown. The field change of the alternating magnetic field producer 37 runs with the exciter frequency continuously from the bottom upwardly in the direction of arrow 40. Preferably, linear motors are acted upon electrically in a multiple phase manner wherein voltages can be fed with network frequencies or higher frequencies up to approximately 1000 Hz.

In the embodiment of FIGS. 1 and 2, coarser lighter particles of the introduced mixture are lifted into the region of higher air velocity above the secondary air inlet connection 14 by means of the alternating magnetic field producer 37 so that the lighter fraction is carried away by a stronger air flow. The entire separating operation proceeds in a manner similar to that described for the embodiment in FIGS. 1 and 2.

The arrangement of the alternating magnetic field producer 37 is somewhat different from the producer in FIGS. 1 and 2 and is located in the region of the inlet opening 104 so that a somewhat different action on the inflowing mixture particles occurs. In this embodiment, the mixture moving over the base edge $A_1$, or the individual particles, respectively, initially turn only the unfavorable narrow side toward the surfaces of the alternating magnetic field producers. As soon as the individual particles are subjected to the airflow path 36 in the airflow passageway 35, the particles reverse position and assume the orientation where each particle is turned toward one of the surfaces of the alternating magnetic field producer 37 at which moment a particle will encounter the full eddy current magnetic thrust in the transverse direction relative to the base edge $A_1$ at the inlet opening 104 from the inlet channel 105. In this embodiment, in accordance with the present invention, the base of the inlet channel 105 can be approximately V-shaped to allow the particles to assume a favorable position with reference to the orientation of the alternating magnetic field producer before reaching the airflow passageway 35. It is not necessary for the inlet channel 105 to be arranged horizontally as shown in FIG. 4 as long as the base edge $A_1$ is provided at the inlet opening 104 into the airflow passageway 35. Moreover, the magnetic field producers 38, 39, as illustrated in FIG. 5, do not necessarily have to be disposed in exactly opposite positions, instead they can be fixed at the same height but in such a way that they are displaced from the drawing plane.

While specific embodiments of the invention have been shown and described in detail to illustrate the application of the inventive principles, it will be understood that the invention may be embodied otherwise without departing from such principles.

I claim:

1. A method of separating non-magnetic, electrically conductive metals in a mixture of solid particles containing a lighter fraction including the non-magnetic electrically conductive metals and a heavier fraction in an upwardly extending airflow passageway having an inlet end at the lower end and an outlet end at the upper end and under the influence of an alternating magnetic field, comprising the steps of directing a first flow of air into the inlet for flow upwardly through the airflow passageway, forming a turbulent air current within the passageway, feeding the mixture of solid particles into the airflow passageway in a single layer form at an angle relative to the direction of air flow upwardly through the airflow passageway said feeding being effected upstream from the inlet to the passageway, locating the alternating magnetic field within the airflow passageway in the region where the mixture enters the airflow passageway and, via said field, repelling into the upwardly flowing air larger sized light particles of non-magnetic, electrically conductive material as well as particles of said material which would be included in the heavy fraction during only air separation because of their form factor and thus separating a lighter fraction of good electrical conductivity, with the lighter fraction being carried upwardly and the heavier fraction dropping downwardly counter to the upwardly flowing air, and directing a second flow of air into the upwardly flowing air within the flow passageway, the directing being effected at a location in or adjacent the region where the mixture is introduced into the airflow passageway, said second flow of air accelerating the airflow to the outlet from the passageway.

2. Method, as set forth in claim 1, including locating the second flow of air in the airflow passageway in the region where the mixture is introduced into the airflow passageway.

3. Method, as set forth in claim 1, including forming the airflow passageway with a tortuous flow path so that the turbulent flow can be developed.

4. Method, as set forth in claim 1, including removing the air and lighter fraction from the outlet of the airflow passageway and conducting the air and the lighter fraction into a cyclone for separating the air and lighter fraction and returning the air for use in the airflow passageway.

* * * * *